United States Patent [19]

Beavers et al.

[11] Patent Number: 4,633,052

[45] Date of Patent: Dec. 30, 1986

[54] MICROWAVE OVEN WITH DISPOSABLE LINER BAG

[76] Inventors: Jerry E. Beavers, P. O. Box 457, Tangerine, Fla. 32777; Jim C. Layland, 5381 Skelly Sq., Orlando, Fla. 32806

[21] Appl. No.: 769,090

[22] Filed: Aug. 26, 1985

[51] Int. Cl.[4] ..... H05B 6/80

[52] U.S. Cl. ..... 219/10.55 E; 219/10.55 M; 219/392; 126/39 M; 99/DIG. 14

[58] Field of Search ..... 219/10.55 R, 10.55 M, 219/10.55 E, 391, 392, 395; 126/39 M; 99/DIG. 14, 451

[56] References Cited

U.S. PATENT DOCUMENTS

| | | | |
|---|---|---|---|
| 2,888,542 | 5/1959 | Mork | 219/10.55 F |
| 2,912,559 | 11/1959 | Kirschke | 219/395 |
| 3,368,732 | 2/1968 | Kimble | 126/39 M |
| 4,343,978 | 8/1982 | Kubiatowicz | 219/10.55 E |
| 4,481,395 | 11/1984 | Smith et al. | 219/10.55 E |
| 4,555,605 | 11/1985 | Brown et al. | 219/10.55 E |

FOREIGN PATENT DOCUMENTS

| | | | |
|---|---|---|---|
| 1158792 | 7/1969 | United Kingdom | 126/39 M |

*Primary Examiner*—Philip H. Leung

*Attorney, Agent, or Firm*—Jacox & Meckstroth

[57] ABSTRACT

A flame-resistant liquid absorbing paper is perforated to define small holes and is folded to form a box-like disposable liner bag having an open end and substantially the same dimensions as the heating and cooking chamber of a microwave oven. The liner bag is provided with fold lines for collapsing the bag to a flat condition for shipping and storage, and strips of pressure sensitive adhesive are carried by side walls of the liner bag for releasably attaching the bag to the microwave oven walls to maintain the open condition of the bag within the oven chamber. The small holes within the liner bag provide for release of vapor generated from a food item being heated or cooked within the bag and/or for air circulation within the oven. The liner bag may also be provided with an opening in the bottom wall for receiving a turntable or rotary platform within the oven chamber.

11 Claims, 5 Drawing Figures

MICROWAVE OVEN WITH DISPOSABLE LINER BAG

BACKGROUND OF THE INVENTION

In the use of microwave ovens, which are installed in homes, restaurants and other commercial establishments, it is not uncommon for the food items being heated or cooked to overflow slightly or splatter within the microwave oven chamber. Usually, the oven chamber is defined by walls of a plastics material or metal such as stainless steel, and have smooth inner surfaces to facilitate cleaning of the wall surfaces after the oven has been used for some period of time. The cleaning operation is usually performed manually with a sponge and a detergent solution and must be performed frequently if the microwave oven receives extensive use, for example, in a commercial kitchen or in association with food vending machines. In such uses and in some home uses, considerable time and effort are required to maintain the microwave oven chamber in a clean and sanitary condition.

SUMMARY OF THE INVENTION

The present invention is directed to a microwave oven incorporating an inexpensive disposable liner element or bag which is adapted to be quickly and easily installed within the chamber of a microwave oven for collecting minor spills and splatters and which may also be quickly and easily removed when it is desired to replace the liner bag. In accordance with one embodiment of the invention, a flame-resistant, liquid-absorbing paper is perforated or cut to define small holes. The paper is then formed into a box-like bag having an open end and substantially the same dimensions as the microwave oven chamber. The perforated liner bag has fold lines for collapsing the bag for shipping and storage, and is also provided with pressure sensitive high tack adhesive for releasably attaching the bag to the walls defining the microwave oven chamber.

The open end of the liner bag is positioned adjacent the microwave oven door, and the bottom wall of the liner bag may be provided with a hole or opening for receiving a carousel or rotary platform within the oven chamber. The liner bag of the invention substantially reduces the time and effort required for maintaining the internal walls of a microwave oven in a clean and sanitary condition, and is especially useful in a microwave oven installed in a kitchen or other food service area where the oven is not conveniently located near a sink.

Other features and advantages of the invention will be apparent from the following description, the accompanying drawing and the appended claims.

DESCRIPTION OF THE PREFERRED EMBODIMENTS

Figure 1:
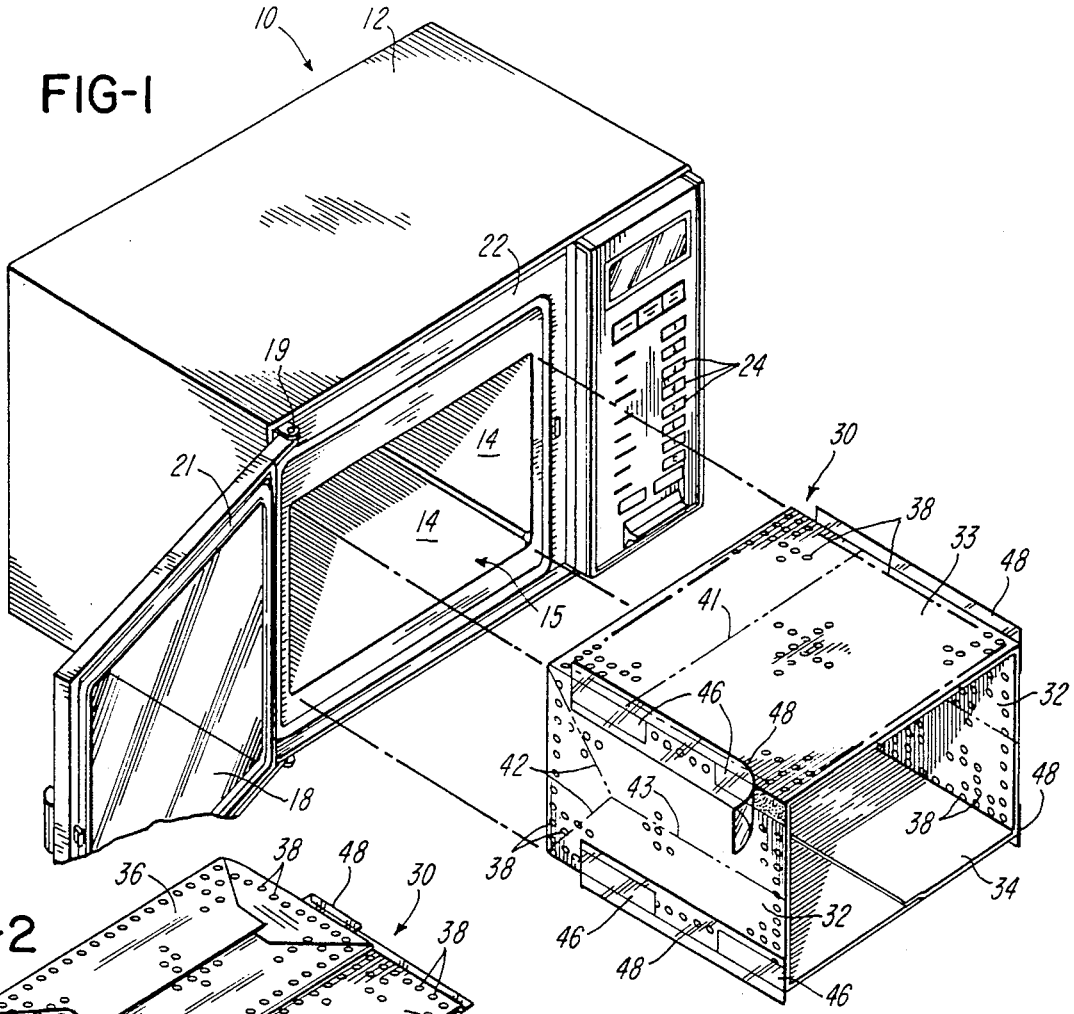
FIG. 1 is a perspective view of a microwave oven and an oven chamber liner bag constructed in accordance with the invention, with the liner bag shown in its open condition and exploded from the chamber.

FIG. 1 illustrates a conventional domestic-type microwave oven 10 commonly used in a residence and including a rectangular box-like cabinet 12. The cabinet 12 encloses inner walls 14 of a sheet metal or plastics material, and the walls 14 define a microwave oven chamber 15 having a front opening. A door 18 is pivotally connected by hinges 19 to the cabinet 12 and carries a peripherally extending resilient seal 21 which is adapted to engage the front wall 22 of the microwave oven 10 around the front opening of the chamber 15. The microwave oven 10 has a series of oven controls 24 which are set by the operator after the door 18 is closed in order to start the microwave generator and to control or select its level of energy output and its time period of operation.

In accordance with the present invention, the walls 14 defining the microwave oven chamber 15 are lined with a disposable liner bag 30 which has the general appearance of a shopping bag or grocery bag. The liner bag 30 is constructed or formed from a flame-resistant, liquid-absorbing paper having a high wet strength and a thickness of about 0.010 inch. One such paper which has provided satisfactory results is a Grade R.W.A-100 paper manufactured by Central State Diversified, Inc. in St. Louis, MO. and sold for industrial uses under the trademark SPARK GARD. The flame-resistant paper is folded to form the liner bag 30 according to the dimensions of the microwave oven chamber 15. The bag 30 includes opposing vertical side walls 32 integrally connected by a top wall 33, a bottom wall 34 and an end wall 36. As shown in FIG. 1, the end of the bag 30 opposite the wall 36 is open and conforms substantially to the open end of the oven chamber 15.

Figure 5:
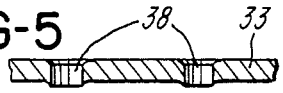
FIG. 5 is a greatly enlarged fragmentary section of a wall portion of the liner bag shown in FIGS. 1–3 or FIG. 4.

Before the flame-resistant paper material is folded into the shape of the bag 30, the portions of the paper forming all of the walls, except for the bottom wall 34, are perforated or cut to form small openings or holes 38 as shown in FIG. 5. The holes are illustrated as being circular and large and in closely spaced relation, for example, with about ¼ inch spacing between adjacent holes. However, the holes 38 may be any shape and may be formed by slitting or cutting the papers to produce flaps which flex in response to differential air pressure to define the holes. The bottom wall 34 of the liner bag 30 is not cut or perforated to define holes so that if any small amount of liquid spills onto the bottom wall 34, it will be retained or absorbed by the paper material and will not pass through the bottom wall.

The flame-resistant paper material forming the liner bag 30 is also provided with a set of fold lines 41 in the top wall 33 and bottom wall 34 and a set of fold lines 42 and 43 within each side wall 32. The fold lines enable the bag to be folded into a flat condition (FIG. 2) for shipping and storage in the same manner as a conventional paper shopping bag or grocery bag. The bottom end wall 36 of the liner bag 30 is also formed with overlapping flap portions in the same manner as a shopping or grocery bag. In fact, it is desirable for the liner bag 30 to be formed or folded in the same manner as a shopping or grocery bag in order to use commercially available adjustable equipment commonly used for producing such bags.

Figure 2:
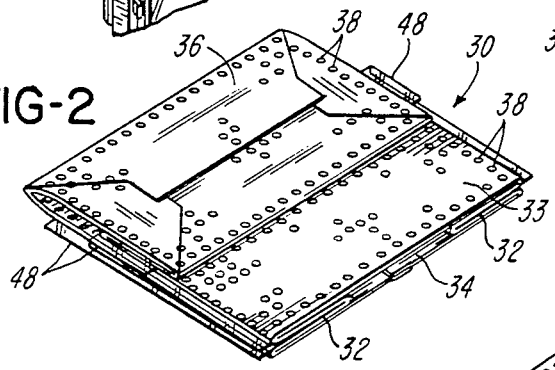
FIG. 2 is a perspective view of the liner bag of FIG. 1 and shown in its collapsed condition.
Figure 3:
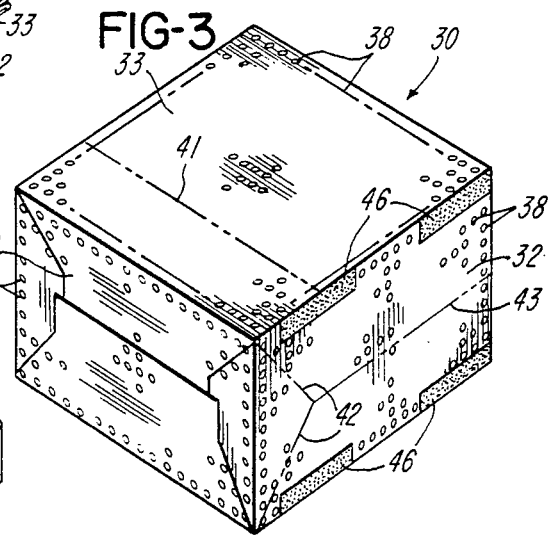
FIG. 3 is another perspective view of the liner bag of FIG. 1 and its open condition.

As also shown in FIG. 1, the upper and lower portions of the opposite side walls 32 of the liner bag 30 are provided with spots or strips 46 of pressure sensitive high tack adhesive, and the adhesive strips are covered or protected by releasable strips 48 of silicon coated or wax-type paper which remain with the liner bag during shipping and storage, as shown in FIG. 2. One adhesive which has provided satisfactory test results is "High Tack Adhesive 76" produced by the 3M Company in St. Paul, Minn. When it is desired to insert a liner bag into the microwave oven chamber 15, the bag is unfolded to its erected or open position (FIG. 1), and the protective strips 48 are peeled from the underlying adhesive spots or strips 46. The liner bag 30 is then inserted into the oven chamber 15 while the bag is partially collapsed. The bag is then fully opened, and the adhesive spots or strips 46 are pressed against the oven walls defining the microwave chamber so that the liner bag 30 is retained or maintained in its fully open position or condition within the oven chamber 15.

After a liner bag 30 has collected the splatter from a number of uses of the microwave oven and it is desired to replace the liner bag 30, the tacky adhesive strips 46 are pulled from the oven walls by manually collapsing the liner bag 30 within the oven chamber 15. When the liner bag is fully collapsed, the upper and lower adhesive strips 46 on each side wall 32 of the liner bag 30 contact each other and retain the bag in its collapsed condition. The collapsed used liner bag is then disposed of in a trash receptacle, and a fresh or new liner bag 30 is inserted into the microwave oven chamber in the manner as described above.

Figure 4:
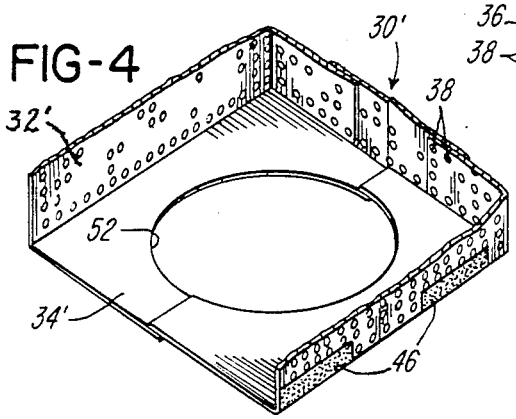
FIG. 4 is a fragmentary perspective view of a liner bag constructed in accordance with a modification of the invention.

In some microwave ovens, the bottom wall is provided with a carousel or rotating platform (not shown) to provide for more uniform heating or cooking of the food item or items within the oven chamber. For such type of microwave ovens, a liner bag 30′ (FIG. 4) has a bottom wall 34′ with a large circular opening 52 having a diameter approximately the same size as diameter of the rotatable platform adjacent the bottom wall of the oven chamber. The liner bag 30′ is inserted into the microwave oven chamber while the bag is partially collapsed and the rotatable platform is projected through the opening 52 so that the bottom wall 34′ of the liner bag 30′ seats on the bottom wall of the oven chamber. The side walls 32′ carry adhesive spots or strips in the same manner as the sidewalls 32 of the liner bag 30.

It is apparent from the drawing and the above description that a microwave oven provided with an inexpensive liner bag 30 or 30′ constructed in accordance with the present invention provides desirable features and advantages. The liner bag substantially reduces the time required for periodically cleaning the walls defining a microwave oven chamber, and this reduction in time is especially desirable in a commercial kitchen where a microwave oven may be used on a continuous basis during food preparation and it is important to minimize the time required for cleaning all food preparation equipment. Microwave ovens are also frequently used in association with food vending machines and in areas where there is no sink conveniently available for use in cleaning the oven. In such uses of a microwave oven, a liner bag constructed in accordance with the invention minimizes the time and effort required to keep the oven clean and sanitary. In addition, the holes 38 within the liner bag provide for the release or escape of vapor generated from a food item being heated or cooked within the liner bag and/or for the flow of air through the bag, if necessary to provide for proper operation and cooling of the microwave oven components. The flame-resistant paper material also assures that the liner bag will not be scorched and support combustion in the event a heated food item within the bag is overheated or overcooked or splatters or spills.

While the form of microwave oven liner bag and its method of construction and use herein described constitute a preferred embodiment of the invention, it is to be understood that the invention is not limited to the precise form and method described, and that changes may be made therein without departing from the scope and spirit of the invention as defined in the appended claims.

The invention having thus been described, the following is claimed:

1. In a microwave oven including a cabinet having walls defining a generally rectangular cooking chamber with a front opening, a door supported by said cabinet for movement between a closed position covering said opening and an open position providing access to said chamber, and means for producing microwave energy within said chamber when said door is in said closed position, the improvement comprising a disposable liner bag for said chamber, said liner bag being formed of a liquid absorbing and fire retardant paper material, said liner bag having fold lines for collapsing said bag between a generally flat collapsed position and an erected box-like open position, said liner bag being generally the same size as said chamber when said liner bag is in said open position and having means defining an opening adjacent said door, and patches of pressure sensitive adhesive on the outer surface of said liner bag for releasably attaching said liner bag in said open position to said walls defining said oven chamber.

2. A microwave oven as defined in claim 1 wherein said liner bag comprises means defining an array of small holes within upper portion of said bag.

3. A microwave oven as defined in claim 2 wherein said liner bag includes opposite side walls connected by a top wall, and said top wall includes said small holes for releasing vapor generated within said bag and/or to provide for air flow through said bag.

4. A microwave oven as defined in claim 2 wherein said liner bag includes opposite vertical side walls connected by top, bottom and rear walls, and said top, rear and side walls each include said holes.

5. A microwave even as defined in claim 2 wherein said holes within said liner bag are defined by corresponding cut portions of said bag.

6. A microwave oven as defined in claim 2 wherein said holes are generally circular and have a diameter on the order of to the thickness of said paper material.

7. A microwave oven as defined in claim 1 wherein said liner bag includes generally vertical opposite side walls when said bag is in said open position within said chamber, said adhesive patches are carried by said side walls, and protective sheets covering said adhesive patches and being strippable therefrom.

8. A microwave oven as defined in claim 1 wherein said liner bag includes opposite vertical side walls connected by horizontal top and bottom walls, and said bottom wall has means defining a large opening for receiving a rotary platform within said chamber of said microwave oven.

9. A method of making and using a disposable liner for a microwave oven chamber formed by internal walls and having a front opening covered by a movable door, comprising the steps of cutting a liquid absorbing and fire retardant paper to a predetermined shape, folding the paper to form a box-shaped disposable liner bag substantially the same size as the oven chamber, creasing the paper to form fold lines for collapsing the liner bag from an open position to a flat position, applying pressure sensitive adhesive patches to portions of the outer surface of the liner bag, inserting the liner bag into the oven chamber, expanding the liner bag to its open position within the oven chamber, and pressing the adhesive patches against the internal walls defining the oven chamber to provide for supporting the liner bag within the oven chamber.

10. A method as defined in claim 9 and including the step of forming a large opening within a bottom wall of the liner bag for receiving a rotary platform located within the oven chamber.

11. A method as defined in claim 9 and including the step of cutting the bag to form small holes within an upper portion of the bag to provide for the flow of air through the bag.

* * * * *